US010208930B1

(12) United States Patent
Hsu

(10) Patent No.: US 10,208,930 B1
(45) Date of Patent: Feb. 19, 2019

(54) CEILING LIGHT WITH LOCKING FUNCTION

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 15/806,460

(22) Filed: Nov. 8, 2017

(51) Int. Cl.

| | |
|---|---|
| ***F21V 17/12*** | (2006.01) |
| ***F21S 8/04*** | (2006.01) |
| ***F21V 3/00*** | (2015.01) |
| ***F21V 19/00*** | (2006.01) |
| ***F21V 23/00*** | (2015.01) |
| ***F21V 23/06*** | (2006.01) |
| *F21Y 115/10* | (2016.01) |

(52) U.S. Cl.
CPC ..... *F21V 17/12* (2013.01); *F21S 8/04* (2013.01); *F21V 3/00* (2013.01); *F21V 19/003* (2013.01); *F21V 19/0015* (2013.01); *F21V 23/001* (2013.01); *F21V 23/06* (2013.01); *F21Y 2115/10* (2016.08)

(58) Field of Classification Search
CPC .... F21V 17/12; F21V 19/003; F21V 19/0015; F21V 23/06; F21V 23/001; F21V 3/00; F21V 3/02; F21V 3/04; F21S 8/04; F21Y 2115/10
See application file for complete search history.

(56) References Cited

U.S. PATENT DOCUMENTS

| | | | | |
|---|---|---|---|---|
| 10,041,632 | B1 * | 8/2018 | Hsieh | F21K 9/235 |
| 2004/0008518 | A1 * | 1/2004 | Wu | F21V 21/02 362/404 |
| 2012/0140495 | A1 * | 6/2012 | Zhang | F21S 6/002 362/431 |
| 2013/0020955 | A1 * | 1/2013 | Igaki | H05B 33/0803 315/201 |
| 2014/0192536 | A1 * | 7/2014 | Hsien | F21V 17/06 362/294 |
| 2018/0213623 | A1 * | 7/2018 | Harada | H05B 33/0845 |

FOREIGN PATENT DOCUMENTS

| | | | |
|---|---|---|---|
| CN | 207334491 U | * | 5/2018 |
| CN | 207394616 U | * | 5/2018 |

* cited by examiner

*Primary Examiner* — Joseph L Williams
*Assistant Examiner* — Jose M Diaz
(74) *Attorney, Agent, or Firm* — Alan D. Kamrath; Kamrath IP Lawfirm, P.A.

(57) ABSTRACT

A ceiling light includes a threaded rod, a light source module, a tray, a locking member and an outer lampshade. The threaded rod in turn extends through the tray, the light source module, the locking member and the outer lampshade. The outer lampshade is provided with a screw hole screwed onto the lower end of the threaded rod. A receiving space is defined between the tray and the outer lampshade. The light source module is received in the receiving space. The light source module includes a wire board mounted on the tray and an inner lampshade mounted on the wire board. The locking member is mounted on the threaded rod and rests on the bottom of the light source module.

9 Claims, 11 Drawing Sheets

CEILING LIGHT WITH LOCKING FUNCTION

BACKGROUND OF THE INVENTION

1. Field of the Invention

The present invention relates to a lighting device and, more particularly, to a ceiling light.

2. Description of the Related Art

A conventional ceiling light comprises a lamp seat and a lampshade. The lamp seat and the lampshade are mounted on a ceiling (or a wall) by screws. The ceiling has a determined height so that the worker has to stand on a ladder to mount the ceiling light onto the ceiling. In assembly, it is necessary to hold the ceiling light by his one hand and to operate the screws by his other hand, thereby causing inconvenience to the worker when mounting the ceiling light. In addition, the ceiling light is not dismantled easily.

BRIEF SUMMARY OF THE INVENTION

The primary objective of the present invention is to provide a ceiling light with a locking function.

In accordance with the present invention, there is provided a ceiling light comprising a threaded rod, a light source module, a tray, a locking member and an outer lampshade. The threaded rod in turn extends through the tray, the light source module, the locking member and the outer lampshade. The outer lampshade is provided with a screw hole screwed onto a lower end of the threaded rod. A receiving space is defined between the tray and the outer lampshade. The light source module is received in the receiving space. The light source module includes a wire board mounted on the tray and an inner lampshade mounted on the wire board. The locking member is mounted on the threaded rod and rests on a bottom of the light source module.

According to the primary advantage of the present invention, the tray and the light source module are mounted on the threaded rod by restriction of the locking member, so that the ceiling light is assembled easily and steadily, without needing a manual supporting or lifting, thereby facilitating the user assembling the ceiling light, and enhancing the efficiency of assembly.

According to another advantage of the present invention, the ceiling light has a wire release function so that the ceiling light is dismantled easily and conveniently.

According to a further advantage of the present invention, the light source module functions as an independent light source that is available for ceiling lights of different types.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
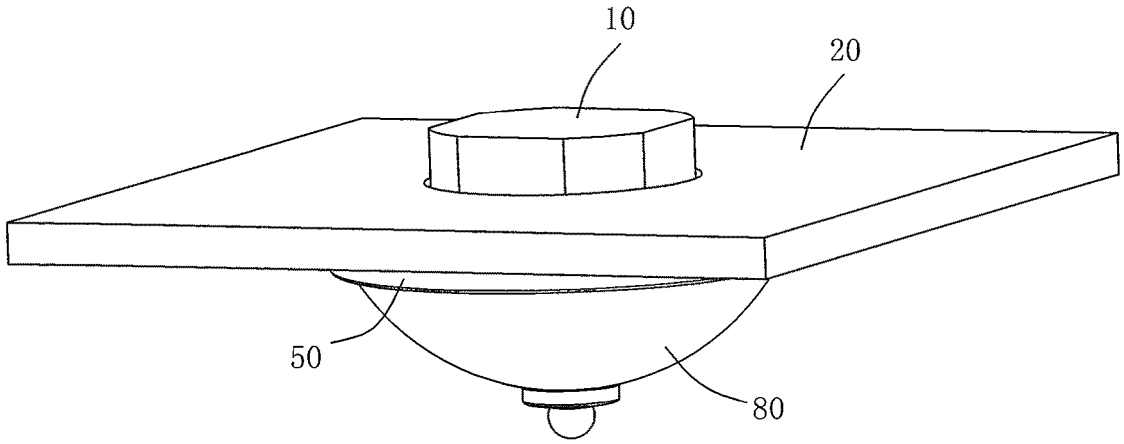
FIG. 1 is a perspective view of a ceiling light in accordance with the preferred embodiment of the present invention.
Figure 2:
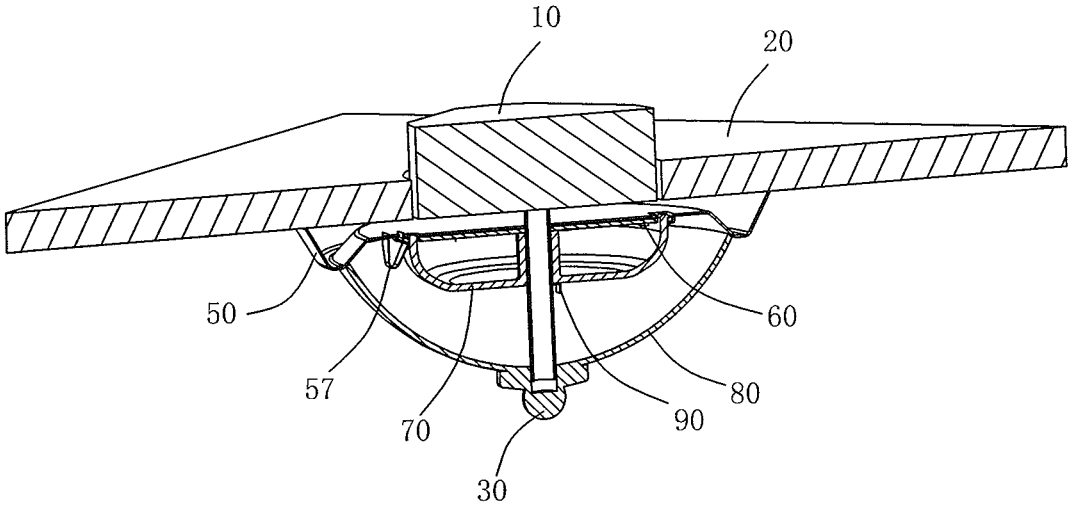
FIG. 2 is a front cross-sectional view of the ceiling light as shown in FIG. 1.
Figure 3:
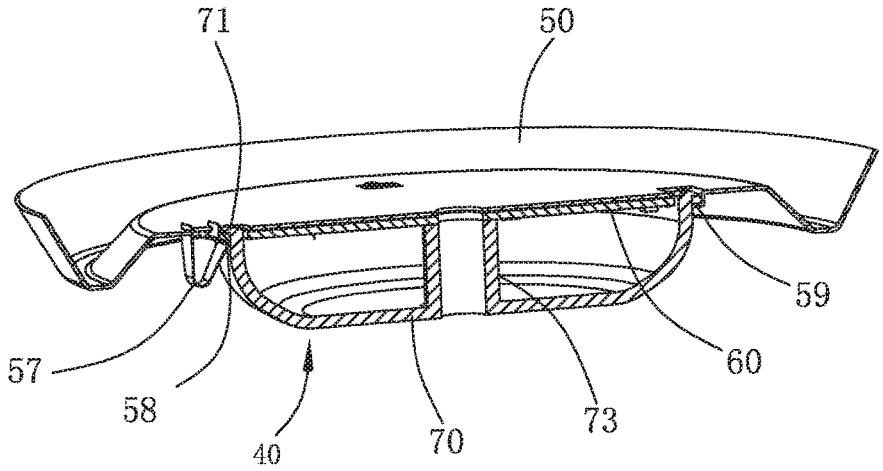
FIG. 3 is a locally enlarged view of the ceiling light as shown in FIG. 2.
Figure 4:
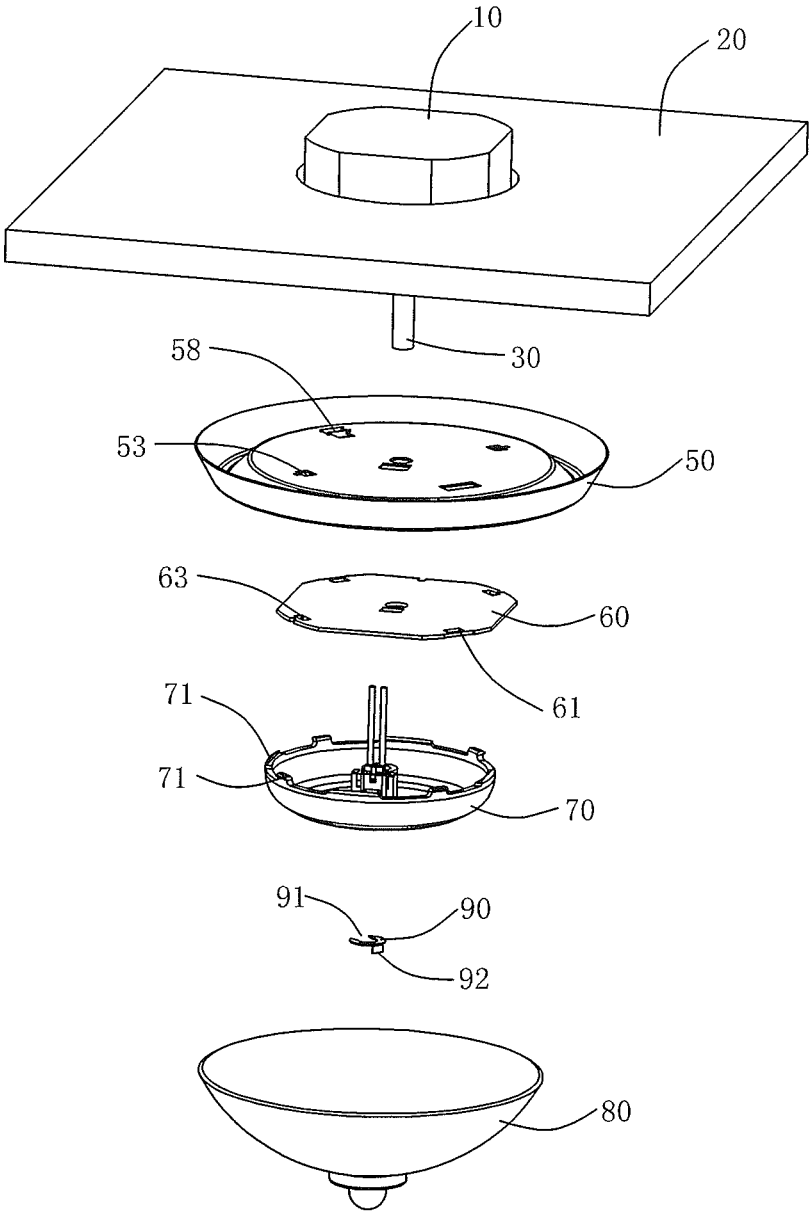
FIG. 4 is an exploded perspective view of the ceiling light as shown in FIG. 1.
Figure 5:
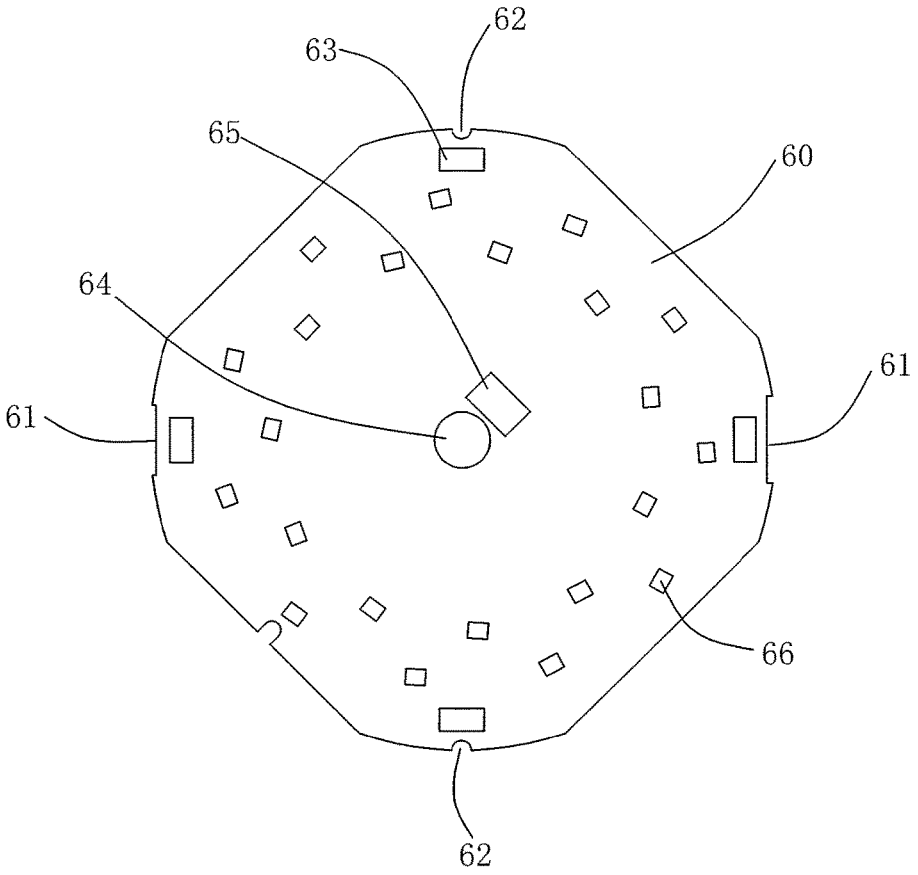
FIG. 5 is a bottom view of a wire board of the ceiling light as shown in FIG. 4.
Figure 6:
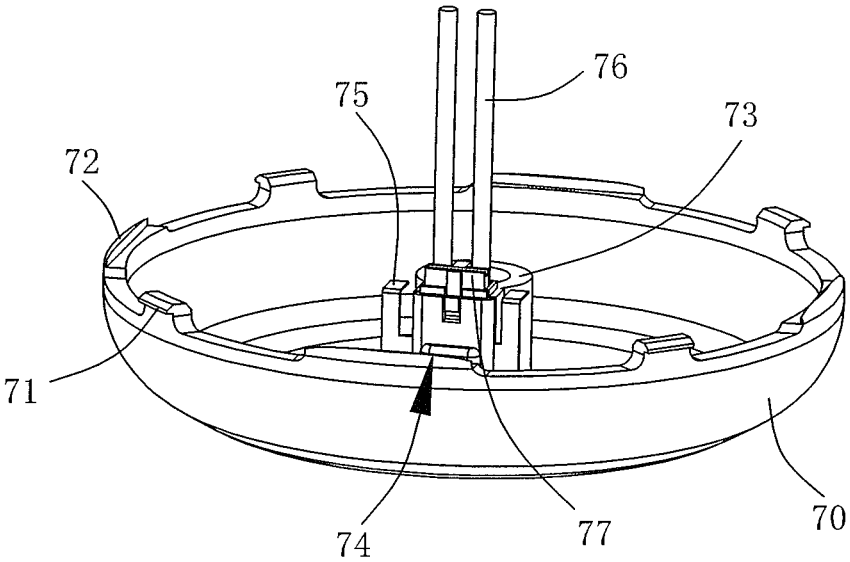
FIG. 6 is an enlarged perspective view of an inner lampshade of the ceiling light as shown in FIG. 4.
Figure 7:
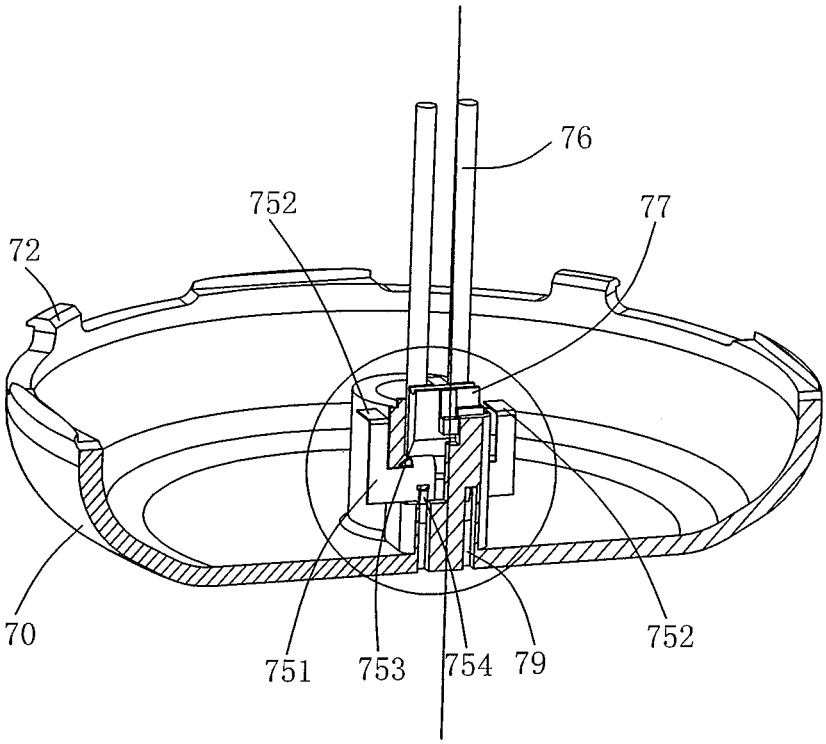
FIG. 7 is an enlarged cross-sectional view of the inner lampshade of the ceiling light as shown in FIG. 6.
Figure 8:
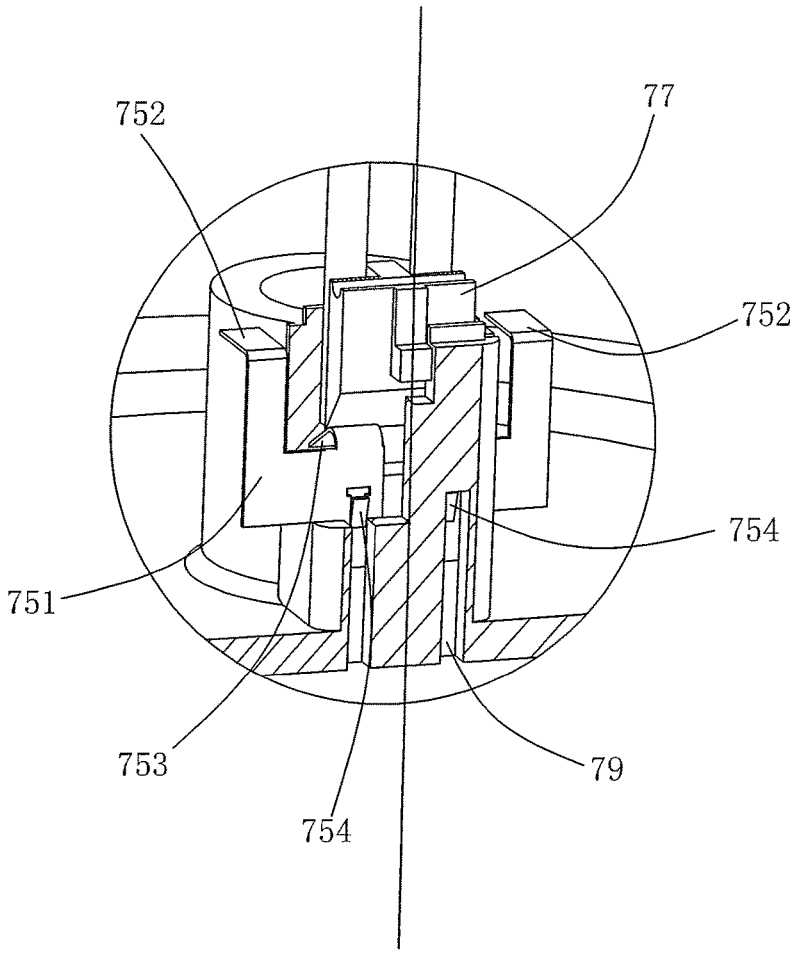
FIG. 8 is a locally enlarged view of the inner lampshade of the ceiling light as shown in FIG. 7.
Figure 9:
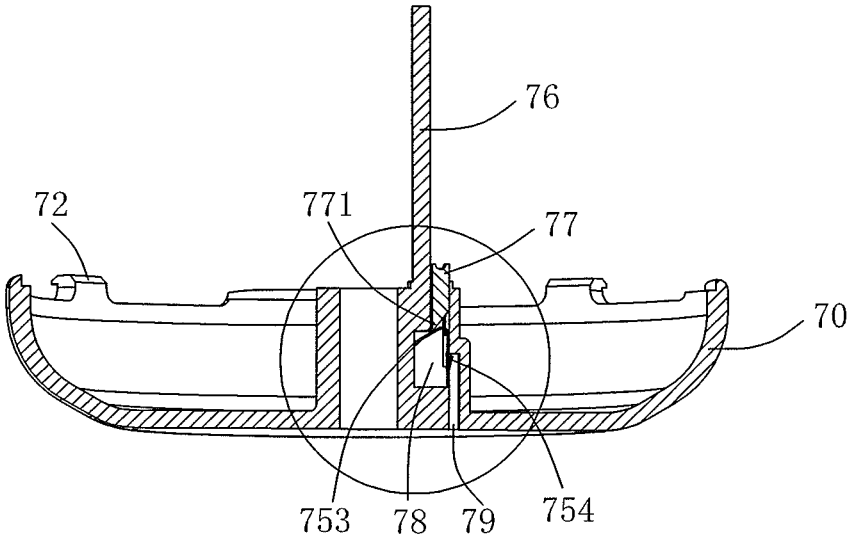
FIG. 9 is a planar cross-sectional view of the inner lampshade of the ceiling light as shown in FIG. 6.
Figure 10:
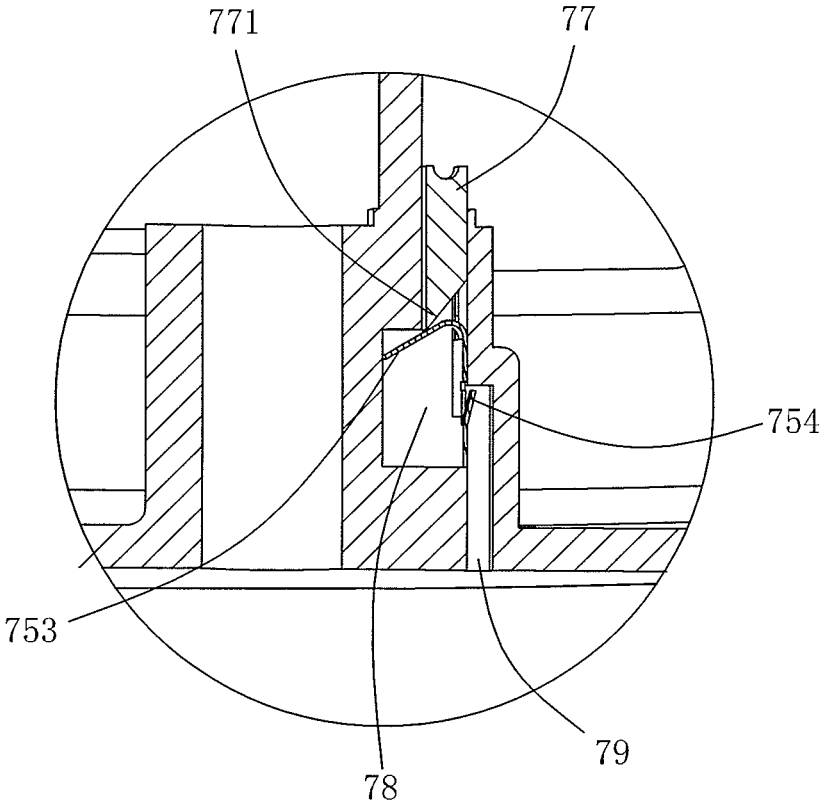
FIG. 10 is a locally enlarged view of the inner lampshade of the ceiling light as shown in FIG. 9.
Figure 11:
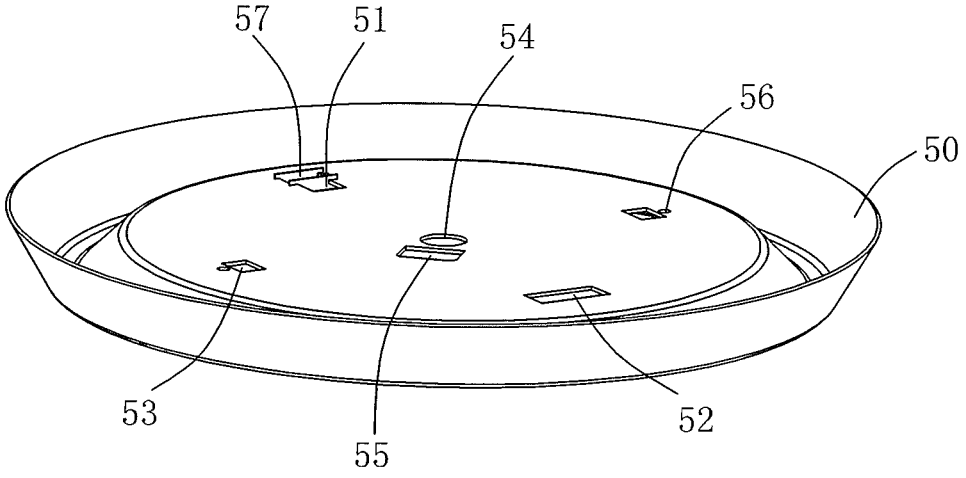
FIG. 11 is an enlarged perspective view of a tray of the ceiling light as shown in FIG. 4.

Referring to FIGS. 1-11, a ceiling light in accordance with the preferred embodiment of the present invention comprises a threaded rod 30, a light source module 40, a tray 50, a locking member 90 and an outer lampshade 80. The threaded rod 30 is mounted on a ceiling. The threaded rod 30 in turn extends through the tray 50, the light source module 40, the locking member 90 and the outer lampshade 80. The outer lampshade 80 covers the tray 50 and is provided with a screw hole screwed onto a lower end of the threaded rod 30 to lock the outer lampshade 80 onto the threaded rod 30. A receiving space is defined between the tray 50 and the outer lampshade 80. The light source module 40 is received in the receiving space. The light source module 40 includes a wire board 60 mounted on the tray 50 and an inner lampshade 70 mounted on the wire board 60. The locking member 90 is mounted on the threaded rod 30 and rests on a bottom of the light source module 40 to restrict the light source module 40.

In the preferred embodiment of the present invention, the wire board 60 is provided with a plurality of first locking holes 63, and the inner lampshade 70 is provided with a plurality of locking hooks 71 locked in the first locking holes 63 of the wire board 60.

In the preferred embodiment of the present invention, the inner lampshade 70 is provided with a plurality of projections 72 locked onto a periphery of the wire board 60.

In the preferred embodiment of the present invention, the wire board 60 is provided with two locking openings 61. The tray 50 is provided with an elastic plate 57 and a restriction plate 59 locked in the two locking openings 61 of the wire board 60 respectively.

In the preferred embodiment of the present invention, the tray 50 is further provided with a second locking hole 51 and a third locking hole 52 respectively aligning with the two locking openings 61 of the wire board 60. The elastic plate 57 of the tray 50 is mounted in the second locking hole 51. The restriction plate 59 extends outward from a bottom of the tray 50 and is located under the third locking hole 52. The restriction plate 59 is locked in the one of the two locking openings 61 of the wire board 60.

In the preferred embodiment of the present invention, the elastic plate 57 is substantially U-shaped and is provided with a limit protrusion 58 locked in the other one of the two locking openings 61 of the wire board 60 to restrict the wire board 60 by the limit protrusion 58.

In the preferred embodiment of the present invention, the locking member 90 is substantially C-shaped and is provided with a retaining hole 91 and a regulating block 92. The retaining hole 91 is locked onto the threaded rod 30. The regulating block 92 extends downward from a bottom of the locking member 90 and is perpendicular to the locking member 90 to facilitate mounting of the locking member 90.

In the preferred embodiment of the present invention, the inner lampshade 70 is further provided with a wire connecting seat 74 which is provided with two conducting blades 75 connected with two conducting wires 76 respectively. Each of the two conducting blades 75 includes a body portion 751, a first contact 752 mounted on the body portion 751, a second contact 753 mounted on the body portion 751, and a release portion 754 mounted on the body portion 751. The first contact 752 of each of the two conducting blades 75 is electrically connected with the wire board 60. The second contact 753 of each of the two conducting blades 75 is electrically connected with one of the two conducting wires 76. An acute angle is defined between the second contact 753 and the body portion 751 of each of the two conducting blades 75.

In the preferred embodiment of the present invention, the wire connecting seat 74 is further provided with two slots 78 allowing insertion of the two conducting wires 76. The inner lampshade 70 is further provided with two release holes 79 connected to the two slots 78 respectively. The first contact 752 of each of the two conducting blades 75 protrudes outward the wire connecting seat 74. The second contact 753 of each of the two conducting blades 75 is locked in one of the two slots 78 of the wire connecting seat 74. The release portion 754 of each of the two conducting blades 75 extends into one of the two release holes 79. Each of the two conducting wires 76 is inserted into one of the two slots 78 and is electrically connected with the second contact 753 of one of the two conducting blades 75.

In the preferred embodiment of the present invention, the wire connecting seat 74 is further provided with a locking block 77. The locking block 77 has a bottom provided with a limit wedge 771, with a release space being defined between the limit wedge 771 and a wall of each of the two slots 78. The second contact 753 of each of the two conducting blades 75 is partially received in the respective release space. The limit wedge 771 of the locking block 77 has two ends each pressing the second contact 753 of each of the two conducting blades 75.

In detachment of the light source module 40, the release portion 754 of each of the two conducting blades 75 is pushed upward by a tool, so that the second contact 753 is pressed upward and extends into the release space, and the distal end of the second contact 753 is retracted toward the body portion 751, to increase the distance between the distal end of the second contact 753 and one of the two slots 78, such that each of the two conducting wires 76 is released and detached easily from one of the two slots 78.

In the preferred embodiment of the present invention, the ceiling light further comprises a wire connection box 10 and a wall board mounted on the wire connection box 10. The threaded rod 30 is mounted on the bottom of the wire connection box 10. The wire board 60 has a square shape and is further provided with two threaded openings 62, a first mounting hole 64 and a second mounting hole 65. The bottom of the wire board 60 is provided with a plurality of light emitting devices 66. Each of the light emitting devices 66 is preferably a light emitting diode (LED). The inner lampshade 70 has a center provided with a guide post 73 which is provided with a through hole which extends through the guide post 73 and the bottom of the inner lampshade 70. The through hole of the guide post 73 aligns with the first mounting hole 64 of the wire board 60. The wire connecting seat 74 includes a main body. The two conducting blades 75 are mounted on the main body. The two locking blocks 77 are locked on the main body. The two slots 78 are formed in the main body. The tray 50 is further provided with a fourth locking hole 53, a third mounting hole 54, a fourth mounting hole 55 and two screw holes 56. The two screw holes 56 of the tray 50 align with the two threaded openings 62 of the wire board 60, and two fasteners extend through the two threaded openings 62 of the wire board 60 and the two screw holes 56 of the tray 50 to lock the wire board 60 onto the tray 50. Preferably, each of the two fasteners is a screw.

In assembly, the locking hooks 71 of the inner lampshade 70 are locked in the first locking holes 63 of the wire board 60, and the projections 72 of the inner lampshade 70 are locked onto a periphery of the wire board 60, so that the inner lampshade 70 and the wire board 60 are combined to construct the light source module 40. Then, when the light source module 40 is mounted on the tray 50, the restriction plate 59 of the tray 50 is locked in the one of the two locking openings 61 of the wire board 60, and the limit protrusion 58 of the elastic plate 57 is locked in the other one of the two locking openings 61 of the wire board 60. Then, the two fasteners extend through the two threaded openings 62 of the wire board 60 and the two screw holes 56 of the tray 50 to lock the wire board 60 onto the tray 50 so as to attach the light source module 40 to the tray 50. At this time, the wire connecting seat 74 of the inner lampshade 70 extends through the second mounting hole 65 of the wire board 60 and the fourth mounting hole 55 of the tray 50. Then, the tray 50 and the light source module 40 are mounted on the threaded rod 30 which in turn extends through the third mounting hole 54 of the tray 50, the first mounting hole 64 of the wire board 60, and the through hole of the inner lampshade 70. Then, the locking member 90 is mounted on the threaded rod 30. Then, the outer lampshade 80 is screwed onto the threaded rod 30. Thus, assembly of the ceiling light is finished.

Accordingly, the tray 50 and the light source module 40 are mounted on the threaded rod 30 by restriction of the locking member 90, so that the ceiling light is assembled easily and steadily, without needing a manual supporting or lifting, thereby facilitating the user assembling the ceiling light, and enhancing the efficiency of assembly. In addition, the ceiling light has a wire release function so that the ceiling light is dismantled easily and conveniently. Further, the light source module 40 functions as an independent light source that is available for ceiling lights of different types. Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling light comprising:

a threaded rod, a light source module, a tray, a locking member and an outer lampshade;

wherein:

the threaded rod in turn extends through the tray, the light source module, the locking member and the outer lampshade;

the outer lampshade is provided with a screw hole screwed onto a lower end of the threaded rod;

a receiving space is defined between the tray and the outer lampshade;

the light source module is received in the receiving space;

the light source module includes a wire board mounted on the tray and an inner lampshade mounted on the wire board;

the locking member is mounted on the threaded rod and rests on a bottom of the light source module;

the wire board is provided with a plurality of first locking holes; and the inner lampshade is provided with a plurality of locking hooks locked in the first locking holes of the wire board.

2. A ceiling light comprising:

a threaded rod, a light source module, a tray, a locking member and an outer lampshade;

wherein:

the threaded rod in turn extends through the tray, the light source module, the locking member and the outer lampshade;

the outer lampshade is provided with a screw hole screwed onto a lower end of the threaded rod;

a receiving space is defined between the tray and the outer lampshade;

the light source module is received in the receiving space;

the light source module includes a wire board mounted on the tray and an inner lampshade mounted on the wire board;

the locking member is mounted on the threaded rod and rests on a bottom of the light source module; and the inner lampshade is provided with a plurality of projections locked onto a periphery of the wire board.

3. The ceiling light of claim 1, wherein the wire board is provided with two locking openings, and the tray is provided with an elastic plate and a restriction plate locked in the two locking openings of the wire board respectively.

4. The ceiling light of claim 3, wherein:

the tray is further provided with a second locking hole and a third locking hole respectively aligning with the two locking openings of the wire board;

the elastic plate of the tray is mounted in the second locking hole;

the restriction plate extends outward from a bottom of the tray and is located under the third locking hole; and the restriction plate is locked in the one of the two locking openings of the wire board.

5. The ceiling light of claim 4, wherein the elastic plate is substantially U-shaped and is provided with a limit protrusion locked in the other one of the two locking openings of the wire board.

6. A ceiling light comprising;

a threaded rod, a light source module, a tray, a locking member and an outer lampshade;

wherein:

the threaded rod in turn extends through the tray, the light source module, the locking member and the outer lampshade;

the outer lampshade is provided with a screw hole screwed onto a lower end of the threaded rod;

a receiving space is defined between the tray and the outer lampshade;

the light source module is received in the receiving space;

the light source module includes a wire board mounted on the tray and an inner lampshade mounted on the wire board;

the locking member is mounted on the threaded rod and rests on a bottom of the light source module;

the locking member is substantially C-shaped and is provided with a retaining hole and a regulating block;

the retaining hole is locked onto the threaded rod; and the regulating block extends downward from a bottom of the locking member.

7. The ceiling light of claim 1, wherein:

the inner lampshade is further provided with a wire connecting seat which is provided with two conducting blades connected with two conducting wires respectively;

each of the two conducting blades includes a body portion, a first contact mounted on the body portion, a second contact mounted on the body portion, and a release portion mounted on the body portion;

the first contact of each of the two conducting blades is electrically connected with the wire board; and the second contact of each of the two conducting blades is electrically connected with one of the two conducting wires.

8. The ceiling light of claim 7, wherein:

the wire connecting seat is further provided with two slots allowing insertion of the two conducting wires;

the inner lampshade is further provided with two release holes connected to the two slots respectively;

the first contact of each of the two conducting blades protrudes outward the wire connecting seat;

the second contact of each of the two conducting blades is locked in one of the two slots of the wire connecting seat;

the release portion of each of the two conducting blades extends into one of the two release holes; and each of the two conducting wires is inserted into one of the two slots and is electrically connected with the second contact of one of the two conducting blades.

9. The ceiling light of claim 7, wherein:

the wire connecting seat is further provided with a locking block;

the locking block has a bottom provided with a limit wedge, with a release space being defined between the limit wedge and a wall of each of the two slots;

the second contact of each of the two conducting blades is partially received in the respective release space; and the limit wedge of the locking block has two ends each pressing the second contact of each of the two conducting blades.

* * * * *